United States Patent [19]

Hagen

[11] 4,186,972

[45] Feb. 5, 1980

[54] LINEARLY MOVABLE STABILIZER FOR SLIDABLE STRUCTURES

[76] Inventor: Magnus F. Hagen, 434 Panorama Dr., Laguna Beach, Calif. 92651

[21] Appl. No.: 909,921

[22] Filed: May 26, 1978

[51] Int. Cl.[2] ..... F16C 29/04

[52] U.S. Cl. ..... 308/3.8; 312/110

[58] Field of Search ..... 308/3 R, 3.5, 6 R, 3.6, 308/3.8; 312/331, 110, 231

[56] References Cited

U.S. PATENT DOCUMENTS

| | | | |
|---|---|---|---|
| 1,124,570 | 1/1915 | Woltz | 312/110 |
| 3,456,995 | 7/1969 | Nyquist | 312/110 X |
| 3,904,254 | 9/1975 | Hagen et al. | 308/3.8 |

*Primary Examiner*—Douglas C. Butler

*Attorney, Agent, or Firm*—Francis X. LoJacono

[57] ABSTRACT

A linearly movable stabilizer for slidable structures, particularly with respect to drawers which are wider in width than in depth, and have a tendency to canter or bind during movement thereof, the stabilizer comprising a fixed-track member attached to the rear of the slidable structure transversely to the movement thereof, wherein a bearing slide mechanism is slidably supported in the track, and wherein a long arm member is pivotally attached at one end to the bearing slide mechanism and the other end is pivotally attached to a stationary structure associated with the slidable structure, a second shorter arm member being pivotally secured at one end to the fixed track and the other end thereof being pivotally attached to the central portion of the long arm member. This arrangement provides a controlled in-and-out movement of the slidable structure—thus preventing cantering or binding of the sides thereof.

4 Claims, 5 Drawing Figures

LINEARLY MOVABLE STABILIZER FOR SLIDABLE STRUCTURES

BACKGROUND OF THE INVENTION

1. Field of the Invention

This invention relates generally to a device to stabilize the movement of drawers, doors and like slidable structures, and relates more particularly to a stabilizing device thereof that provides a ball-bearing-slide mechanism as a major anti-friction section within the linear stabilizer.

2. Description of the Prior Art

As is well known in the art, various types of anti-racking or binding devices are presently available. However, several problems and difficulties are encountered in providing a device of this character that includes a reliable non-binding support for the movable structure being attached thereto. Most known devices lack the necessary structural strength and load-carrying capacity when these mechanisms are used to control the linear movement of structures (such as drawers, doors and partitions) that are supported between parallel side structures.

In order to meet specific design requirements relating to sliding structures as mentioned above, these mechanisms or devices must operate continuously, smoothly and efficiently under difficult conditions, without allowing the movable structure to become wedged or bound between the parallel fixed structure in which the movable structure is supported.

Present known mechanisms do not provide the absolute free motion which assures the no-racking condition. In other words, the radius forces which accrue by the in/out movement of a wide but shallow drawer or door are checked by the short and long arm of the present invention.

SUMMARY OF THE INVENTION

The present invention relates to a linearly movable stabilizer mechanism that prevents sideward binding movement of a slidable structure that is generally supported between fixed, parallel side walls, such as are found in a structure wherein slidable drawers are supported.

Thus, to provide a controlled, in-and-out, linear movement of a slidable structure, such as a drawer, the present invention comprises an elongated track generally affixed to the rear portion of the movable structure, the track having slidably supported therein a ball-bearing slide mechanism to which an elongated arm member is pivotally attached at one end of the arm. The opposite end of the long arm member is pivotally secured to a fixed structure such as the rear or side wall members of a cabinet.

A second, but short, arm is included which is pivotally affixed at one end directly to the fixed track member, the opposite end being pivotally mounted to the central point of the long arm; that is, the pivot point is located centrally between the ends of the long arm, the long arm being approximately twice the length of the short arm.

Thus, as the drawer is moved in or out, the scissor action of the arms keeps the drawer in a parallel attitude with respect to the cabinet side walls, thus preventing the drawer from cantering to one side or the other, and becoming wedged in the cabinet.

An equal force is applied to the rear of the drawer due to the transverse movement of the frictionless travel of the bearing member in the track.

OBJECTS AND ADVANTAGES OF THE INVENTION

The present invention has for an important object a provision wherein a linear stabilizing device includes a track mounted slide mechanism which allows an equal stabilizing force to be applied over the full width of a sliding structure that is supported within a fixed structure having parallel side walls, wherein the movable structure is slidable therebetween without binding.

It is another object of the invention to provide a linearly movable stabilizer for slidable structures, the stabilizer having a first long arm member pivotally mounted at its respective ends to a fixed structure and the slide mechanism within the track, and a second short arm member pivotally attached to the track at one end and also pivotally attached to the mid-section of the long arm member.

It is still another object of the invention to provide a stabilizer means for sliding structures, and more particularly to flipper doors for lateral file cabinets, so as to allow free transverse movement thereof without binding along the sides thereof.

It is a further object of the present invention to provide a device of this character that includes a scissor arrangement of parts, thus securing a slidable fixture in a parallel attitude with respect to the side walls to which it is associated therewith.

A still further object of the present invention is to provide a device of this character that is relatively inexpensive to manufacture, and simple to install and maintain.

The characteristics and advantages of the invention are further sufficiently referred to in connection with the accompanying drawings, which represent one embodiment. After considering this example, skilled persons will understand that variations may be made without departing from the principles disclosed; and I contemplate the employment of any structures, arrangements or modes of operation that are properly within the scope of the appended claims.

BRIEF DESCRIPTION OF THE DRAWINGS

Referring to the drawings, which are for illustrative purposes only.

DESCRIPTION OF THE PREFERRED EMBODIMENT

Figure 1:
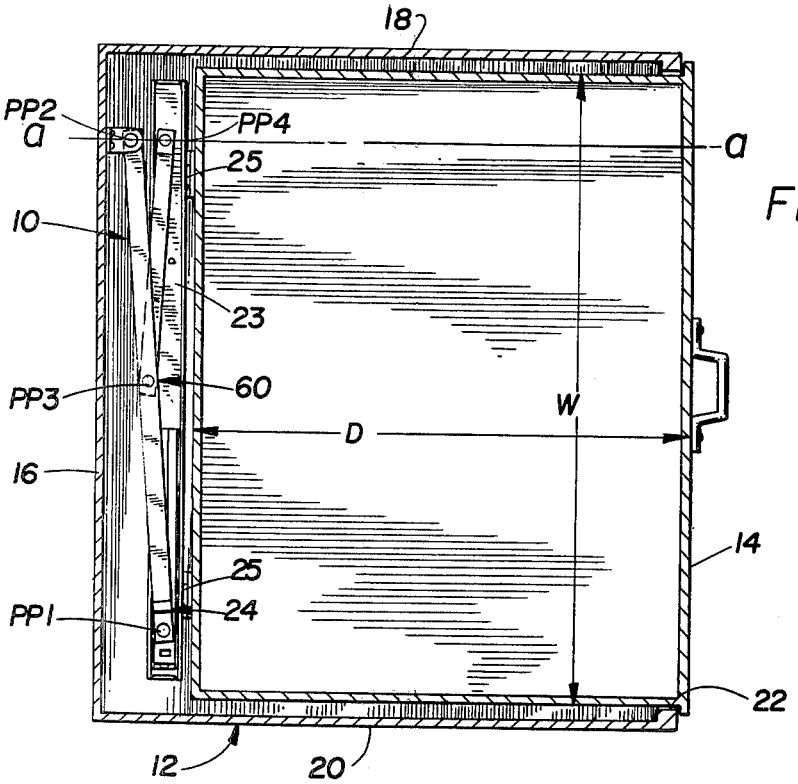
FIG. 1 is a top cross-sectional view of a cabinet having a sliding drawer therein, wherein the present invention is shown in a retracted mode.
Figure 2:
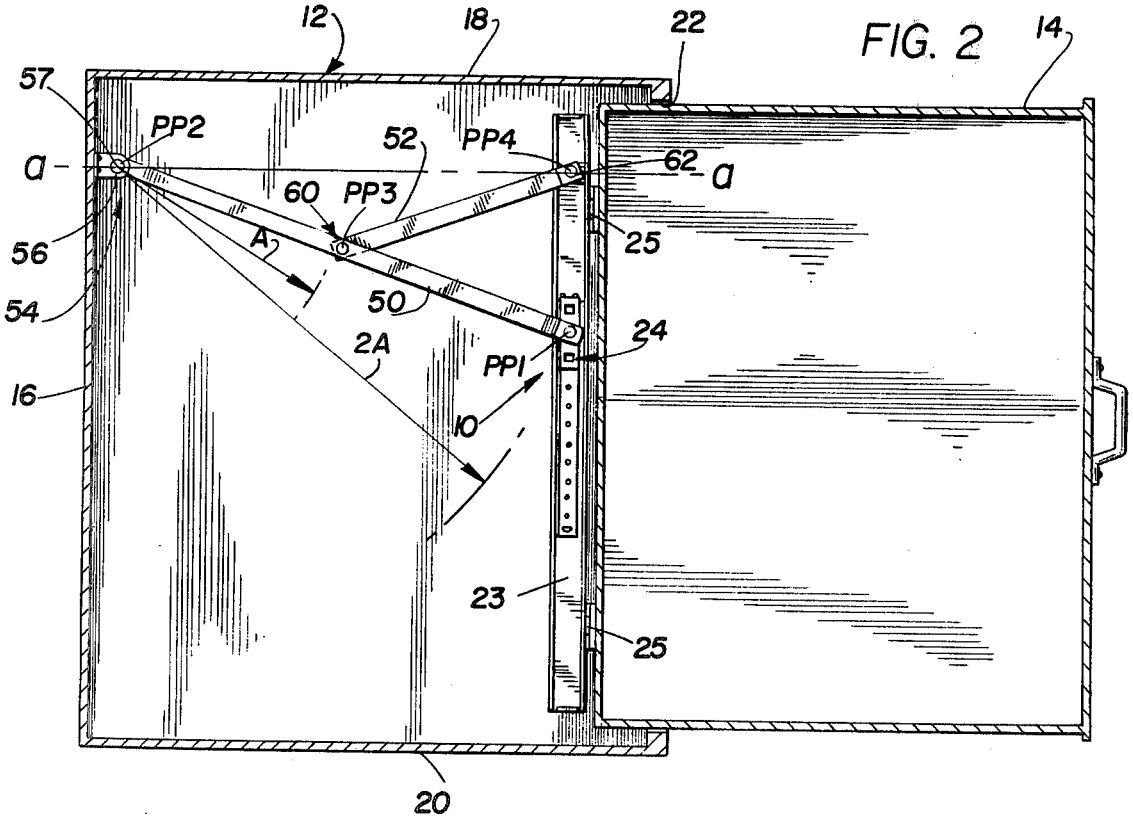
FIG. 2 is a similar cross-sectional view of a cabinet having the drawer extended from the cabinet and the stabilizer in a fully operated mode.
Figure 3:
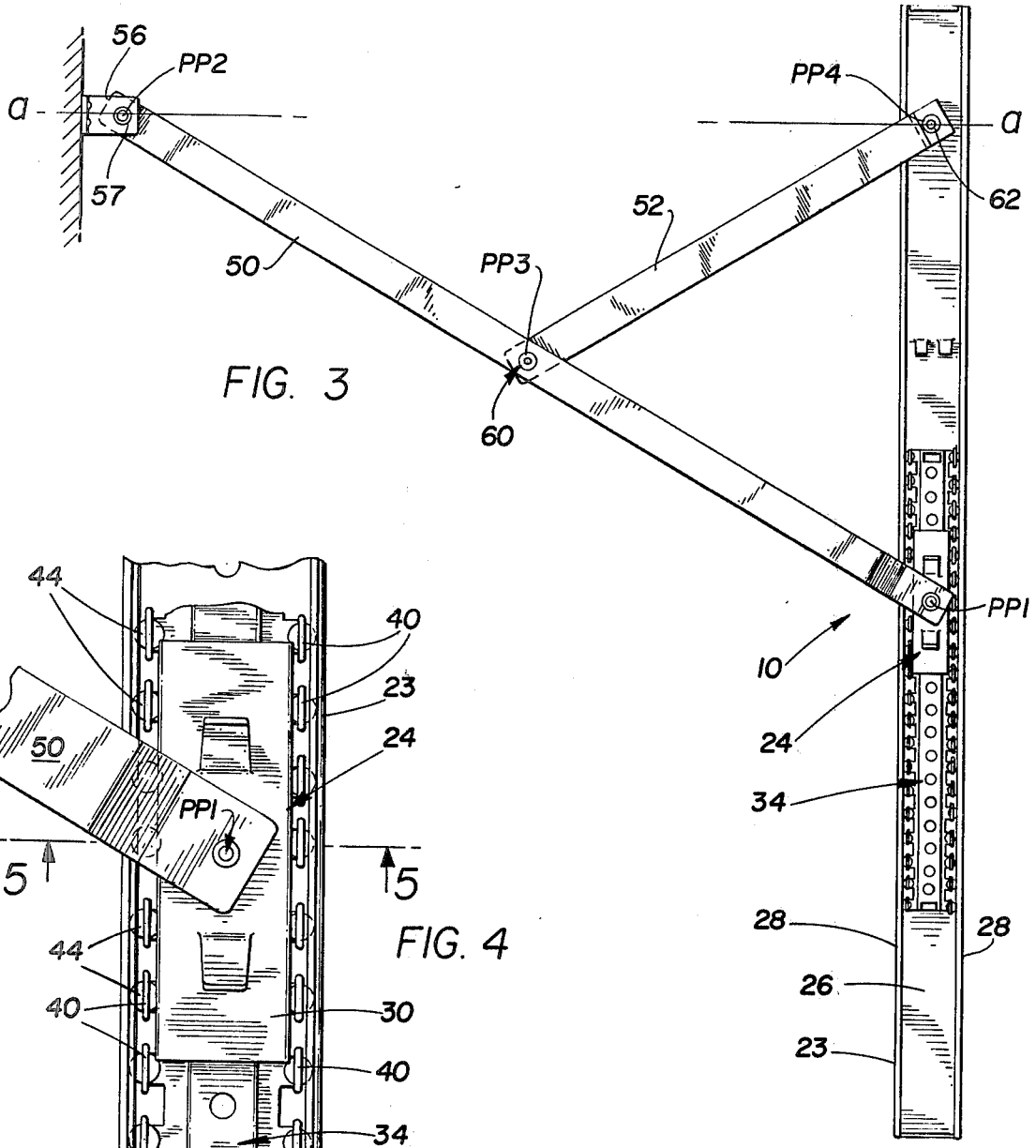
FIG. 3 is an enlarged top plan view of the stabilizer device in a partially open arrangement.
Figure 4:
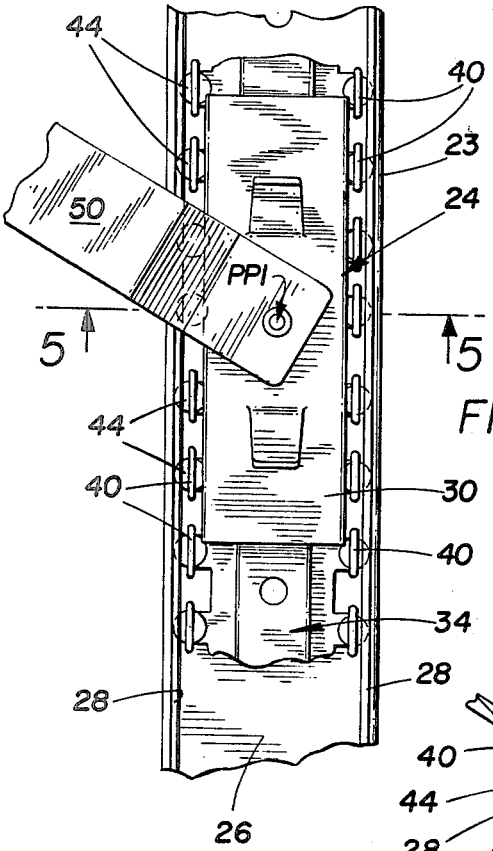
FIG. 4 is an enlarged fragmentary view of the slide mechanism.

Referring more particularly to the drawings, there is shown in FIGS. 1 and 2 a linearly movable stabilizer apparatus, generally indicated at 10, positioned within a substantially stationary structure defining a cabinet 12. Slidably supported within the cabinet is a typical drawer 14 which represents various slidable structures, including doors and the like.

Thus, the cabinet comprises a rear wall 16 and a pair of parallel side walls 18 and 20, whereby the front of the cabinet 12 includes at least one opening 22 to allow drawer 14 to be received therein.

Very often it is found that, due to loads within the drawer and forces applied thereto, there is a great tendency for the sliding structure, such as 12 (having a width, indicated at "W" which is greater than the depth, indicated at "D"), to canter or bind during either the in or the out longitudinal travel thereof.

Accordingly, the present invention comprises a stabilizing means 10 having a main track or outer slide member 23 defining a substantially stationary slide member secured to the rear of the sliding-drawer structure 14. This track can be mounted either directly to the drawer or be provided with hinge means 25 disposed therebetween as seen in FIGS. 1 and 2.

Included with track member 23 is an inner slide member, indicated generally at 24. Slide members 23 and 24 are generally channel-shaped and formed of sheet metal, preferably steel, by stamping—these parts being made with great accuracy.

The track or outer slide member 23 has a longitudinally extending center wall 26 which may be termed the bottom of the channel. Along each side edge of bottom wall 26 is an outwardly and laterally extending ball raceway 28 that is concave and convex in cross-section (See FIG. 5), with a concaved surface facing inwardly, so that said surfaces are oppositely arranged relative to the length of wall 26.

Inner slide member 24 also has a bottom wall, indicated at 30, along the longitudinally extending sides or side edges of which are laterally turned ball raceways 32 which are oppositely arranged and arcuate in cross-section, with the concave surfaces arranged oppositely to respective adjacent ball raceway 28 of the outer slide member, said raceways 28 being spaced from said adjacent raceways 32.

Slide members 23 and 24 are arranged so that their open sides face each other and are disposed between said members. In the space between the parallel walls 26 and 30, there is provided a ball-retainer means, indicated generally at 34. Ball retainer 34 is also channel-shaped and has a bottom wall comprising a shallow, reverse-channel portion 36 which extends longitudinally of the retainer. The side walls 38 of the reverse-channel portion 36 connect with side parts 39 of the ball retainer; and from the outer edges of the ball retainer there extend a series of ball-retaining arms 40 spaced apart longitudinally of the ball retainer 34. The arms at one side of the ball-retainer end generally are parallel to walls 38 of the reverse-channel portion 36. The arms 40 are provided with respective aligned openings 42 for reception of ball bearings 44.

Figure 5:
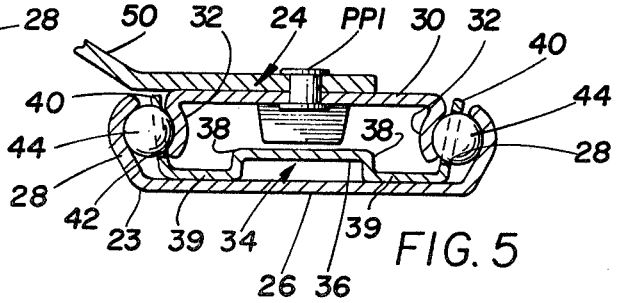
FIG. 5 is an enlarged cross-sectional view of the slide mechanism taken substantially at line 5—5 of FIG. 4.

When the ball retainer is operably disposed in the slide mechanism between the inner and the outer slide members 24 and 23, respectively, the balls 44 are operably positioned in the raceways, as best shown in FIG. 5. The sides 40 of the ball retainer may exert a slight pressure or tension on the balls against the raceways, to minimize or eliminate retainer vibration and possible noise.

Thus, it can be understood that a slide mechanism as herein described is so made as to be very accurate in its structural arrangements and alignments.

The stabilizing device of the present invention further includes a pair of equalizer arms, 50 and 52, whereby each arm applies equal force over the width of the sliding structure or drawer 14. The first long arm member 50 is pivotally mounted at one end thereof to the inner slide member 24, mid-way between the ends of bottom wall 30 at a pivot point PP1. The opposite end of long arm 50 is pivotally secured to stationary rear wall 16 of cabinet 12 by pivot means 54, comprising bracket 56 and pin 57, thereby defining pivot point PP2.

The short arm 52 is connected at one end to the long arm 50 wherein the pivot means 60, defining pivot point PP3, is positioned equidistant between PP1 and PP2. As shown in FIG. 2, distance "A" from PP2 to PP3 is half of distance "2A" from PP2 to PP1. The opposite end of arm 52 is pivotally connected by means 62 to one end of track 23, thereby defining pivot point PP4.

Hence, it is important to note that PP2 and PP4 must be axially aligned along line a—a whether in a closed mode or an open mode (as seen in FIGS. 1 and 2). Thus, bracket 56 could also be mounted to side wall 18, as long as PP2 is aligned with PP4 along axis line a—a.

Accordingly, as drawer 14 is moved inwardly or outwardly, a scissor-equalizing action is created between arms 50 and 52, whereby pivot point PP1 travels longitudinally along track channel 23. Thus, as can be seen in FIG. 1, the inner slide member 24 is positioned at the furthermost end of track 23; wherein point PP3 is located equidistant between point PP1 and points PP2 and PP4.

However, in FIG. 2, the drawer is shown fully extended wherein pivot point PP1 on slide member 24 moves toward PP4. Thus, the radius forces which accrue by the in/out movement of a wide but shallow drawer or like structure are checked by the long and short arms 50 and 52, respectively, and are thus channelled into a fine, smooth, parallel force against the drawer, thereby assuring a no-racking mode of the drawer's in-and-out movement.

The invention and its attendant advantages will be understood from the foregoing description; and it will be apparent that various changes may be made in the form, construction and arrangement of the parts of the invention without departing from the spirit and scope thereof or sacrificing its material advantages, the arrangement hereinbefore described being merely by way of example; and I do not wish to be restricted to the specific form shown or uses mentioned, except as defined in the accompanying claims.

I claim:

1. A linearly movable stabilizer means for linearly slidable structures wherein sideward cantering is prevented thereby, said means consisting of:

an elongated track member attached to said slidable structure transversely to the linear movement thereof, said track member comprising a bottom longitudinally extending center wall and a pair of oppositely disposed and outwardly and laterally extending ball raceways, whereby said bottom center wall and said raceways define an elongated channel;

a slide mechanism adapted to be slidably supported within said channel, said mechanism comprising an inner slide member having a bottom wall and oppositely disposed ball raceways arranged to be oppositely positioned to respective adjacent ball raceways of said track member, ball-retainer means being positioned between said track member and said inner slide member, wherein ball bearings are operably positioned in said corresponding raceways;

a first long arm member having one end thereof pivotally mounted to a fixed support, and the end opposite thereof pivotally connected to said inner slide member to traverse longitudinally within said channel;

a second short arm member interconnected between said first arm member and said track member, thereby defining a substantially "Y"-shaped configuration, wherein one end of said second arm is pivotally attached intermediate the ends of said first arm member, the opposite end of said second arm being pivotally attached adjacent one end of said track member; and pivot means provided at each attaching end of each arm member to allow a controlled movement of said arms and said slide mechanism.

2. A linearly movable stabilizer means as recited in claim 1, wherein said second short arm member is half the length of said first long arm member.

3. A linearly movable stabilizer means as recited in claim 1, wherein pivot means attached between said first long arm member and said fixed support is mounted in axial alignment with said pivot means positioned between said short arm member and said track member, whereby said mentioned pivot means is in continuously axial alignment during slidable movement of said slidable structure.

4. A linearly movable stabilizer means as recited in claim 1, including hinge means interposed and connected between said track member and said slidable structure to allow vertical movement of said track member.

* * * * *